US009781501B2

(12) United States Patent
Grandt et al.

(10) Patent No.: US 9,781,501 B2
(45) Date of Patent: Oct. 3, 2017

(54) EARPIECE AND HEADSET

(71) Applicant: Sennheiser electronic GmbH & Co. KG, Wedemark (DE)

(72) Inventors: André Grandt, Wedemark (DE); Elmar Stein, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 98 days.

(21) Appl. No.: 14/734,289

(22) Filed: Jun. 9, 2015

(65) Prior Publication Data

US 2016/0014495 A1 Jan. 14, 2016

(30) Foreign Application Priority Data

Jun. 11, 2014 (DE) ..... 10 2014 211 181

(51) Int. Cl.

| | |
|---|---|
| ***H04R 1/10*** | (2006.01) |
| ***A61F 11/06*** | (2006.01) |
| ***G10K 11/16*** | (2006.01) |
| ***H03B 29/00*** | (2006.01) |

(52) U.S. Cl.

CPC ..... *H04R 1/1041* (2013.01); *H04R 1/1025* (2013.01); *H04R 2201/107* (2013.01); *H04R 2460/03* (2013.01)

(58) Field of Classification Search

CPC H04R 1/1041; H04R 1/1025; H04R 2460/03; G10K 11/178; G10K 2210/1081

USPC ..... 381/74, 71.1, 71.2, 71.5, 71.11, 71.6, 381/71.7, 71.8, 71.14

See application file for complete search history.

(56) References Cited

U.S. PATENT DOCUMENTS

2007/0274530 A1* 11/2007 Buil ..... H04R 1/1041 381/74
2008/0205678 A1 8/2008 Boguslavskil et al.
2009/0323976 A1* 12/2009 Asada ..... G10K 11/178 381/71.1
2012/0070014 A1 3/2012 Choi (Continued)

FOREIGN PATENT DOCUMENTS

DE 10 2007 009 176 9/2008

OTHER PUBLICATIONS

G.R. Ahmed Jamal. et al; "*Generation of Usable Electric Power from Available Random Sound Energy*". In: International Conference on Informatics, Electronics and Vision (ICIEV), pp. 1-4, May 2013.

(Continued)

*Primary Examiner* — Thjuan K Addy
(74) *Attorney, Agent, or Firm* — Frommer Lawrence & Haug LLP

(57) ABSTRACT

There is provided an earpiece or a headset comprising an audio input for receiving an audio signal to be reproduced, at least one electroacoustic reproduction transducer, an audio unit for effecting audio processing of the received audio signal, at least one converter unit for extracting power from the audio signal received at the audio input, a power storage means for at least partial intermediate storage of the power extracted from the audio signal, and a power control unit for controlling the extraction of the power from the audio signal and for controlling a power supply of the audio unit, in particular by way of the power stored in the power storage means and extracted from the audio signal.

13 Claims, 1 Drawing Sheet

(56) References Cited

U.S. PATENT DOCUMENTS

| | | | |
|---|---|---|---|
| 2012/0114125 | A1 | 5/2012 | Xue et al. |
| 2012/0321097 | A1 | 12/2012 | Braho |
| 2013/0034237 | A1 | 2/2013 | Olafsson et al. |
| 2013/0083927 | A1 | 4/2013 | Savant |
| 2014/0018016 | A1 | 1/2014 | Chang et al. |

OTHER PUBLICATIONS

Ye-Sheng Kuo et al; "*Hijacking Power and Bandwidth from the Mobile Phone's Audio Interface*". In: First Annual Symposium on Computing for Development, pp. 1-10, Dec. 2010.

* cited by examiner

EARPIECE AND HEADSET

The present application claims priority to German Patent Application No. DE 10 2014 211 181.1 filed on Jun. 11, 2014, the disclosures of which are incorporated herein by reference in their entirety.

FIELD OF THE INVENTION

The present invention concerns an earpiece and a headset.

It is noted that citation or identification of any document in this application is not an admission that such document is available as prior art to the present invention.

Earpieces like for example headphones or earphones as well as headsets increasingly have electronics which have to be supplied with power. Those electronics can represent for example an active noise cancellation unit. As the earpieces or headsets are worn in a mobile context the power consumption of the electronics is an important factor. To avoid excessively frequent or excessively fast recharging of the power supply of the earphone or headset either the storage capacity of the power storage means has to be increased and/or the power consumption of the earpiece or the headset has to be reduced.

In the German application from which priority is claimed the German Patent and Trade Mark Office searched the following documents: US 2014/0018016 A1; DE 10 2007 009 176 A1; US 2013/0083927 A1; US 2012/0321097 A1; US 2013/0034237 A1; US 2012/0114125 A1; US 2012/0070014 A1; Jamal, G. R. A. et al; "Generation of usable electric power from available random sound energy". In: International Conference on Informatics, Electronics and Vision (ICIEV), pp 1-4, May 2013 and Kuo, Y.-S. et al; "Hijacking Power and Bandwidth from the Mobile Phone's Audio Interface". In: First Annual Symposium on Computing for Development, pp 1-10, December 2010.

It is noted that in this disclosure and particularly in the claims and/or paragraphs, terms such as "comprises", "comprised", "comprising" and the like can have the meaning attributed to it in U.S. patent law; e.g., they can mean "includes", "included", "including", and the like; and that terms such as "consisting essentially of" and "consists essentially of" have the meaning ascribed to them in U.S. patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112), such that applicant(s) reserve the right to disclaim, and hereby disclose a disclaimer of any previously described product, method of making the product, or process of using the product.

SUMMARY OF THE INVENTION

Therefore an object of the present invention is to provide an earpiece and a headset which manages with reduced power consumption of the mobile power supply of the earpiece or the headset.

Thus there is provided an earpiece or a headset comprising an audio input for receiving an audio signal to be reproduced, at least one electroacoustic reproduction transducer, an audio unit for effecting audio processing of the received audio signal, at least one converter unit for extracting power from the audio signal received at the audio input, a power storage means for at least partial intermediate storage of the power extracted from the audio signal, and a power control unit for controlling the extraction of the power from the audio signal and for controlling a power supply of the audio unit of the power stored in the power storage means and extracted from the audio signal.

According to an aspect of the present invention the power control unit is adapted to limit the mode of operation of the earphone or the headset, in particular the audio unit, if there is no longer sufficient power in the power storage means. In that way the power present can be firstly guaranteed for the functions considered to be important like for example reproduction of the audio signal by way of the electroacoustic reproduction transducer.

According to a further aspect of the present invention the power control unit monitors whether after extraction of power from the received audio signal there is correspondingly power in the audio signal to be able to drive the electroacoustic reproduction transducer and/or operate the audio unit.

The invention also concerns an earpiece or headset comprising an electroacoustic reproduction transducer, an audio unit for effecting audio processing of an audio signal, a boom microphone, at least one converter for extracting power from the microphone feed signal, an input for receiving a microphone feed supply for the boom microphone, a power storage means in which the power extracted from the microphone feed signal is at least partially put into intermediate storage, and a power control unit for controlling extraction of power from the microphone feed signal and for controlling the power supply of the audio unit.

The invention concerns the notion of using the power present in an input audio signal at least partially as the power supply for the electronics of the earpiece or the headset so that the storage capacity of a power storage means of the earpiece or headset can be reduced. If the power in the audio signal is not sufficient to supply all components of the electronics of the earpiece or headset with power then previously determined components or units of the electronics can be supplied with power preferentially. In other words, if there is not sufficient power in the input audio signal then parts of the electronics of the earpiece or the headset can be shut down or deactivated until there is once again sufficient power in the audio signal. The power stored in the audio signal can be extracted and put into intermediate storage for example in a capacitor, for example an ultra-cap. Upon extraction of the power from the input audio signal however it is necessary to provide (for on-going operation) that there is sufficient power in the audio signal to be able to sufficiently actuate the electroacoustic reproduction transducer.

According to the invention the power contained in the audio signal is used not only for the power supply to the electroacoustic reproduction transducer but also at least partially for supplying the electronics of the earpiece or headset.

The invention can be used in mobile audio devices and base stations which have an electronic system. According to the invention the DC/DC converter is so controlled that the input resistance is kept substantially constant.

An audio signal to be reproduced is an audio signal which has substantially no direct component DC. There is no bias but a normal or usual audio signal which is output from an audio output and can be converted into sound by an electroacoustic reproduction transducer.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
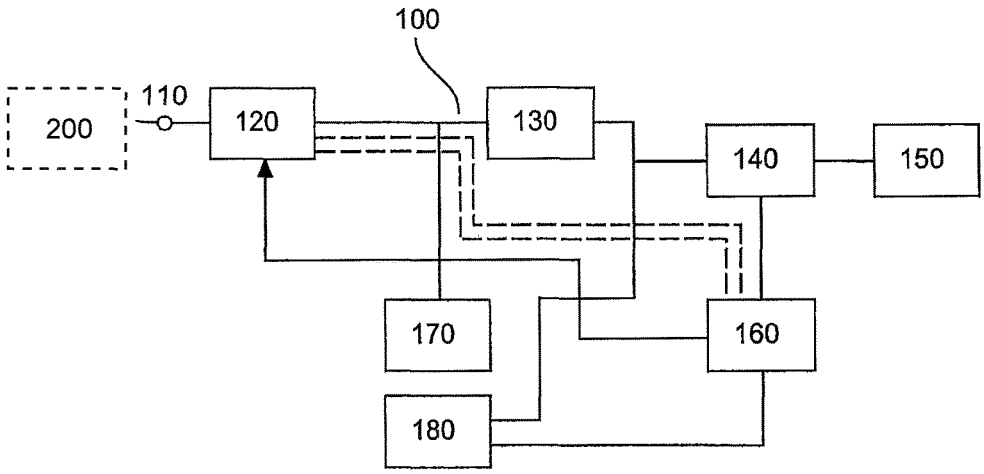
FIG. 1 shows a schematic block circuit diagram of a headphone or a headset according to a first embodiment.

FIG. 1 shows a schematic block circuit diagram of a headphone or a headset according to a first embodiment. The earpiece or the headset has an audio input 110 for receiving an audio signal to be reproduced, a rectifier unit 120 for rectifying the audio signal received by way of the audio input 110, a DC/DC converter unit 130, an audio unit 140, at least one electroacoustic reproduction transducer 150, an power control unit 160, an power storage unit 170 and an electronic unit 180. The audio signal can be output by an external audio source 200 (for example a media player, a smartphone etc).

The audio signal which is to be reproduced and which is produced or output by the external audio source 200 represents an audio signal substantially without direct component DC. That audio signal can optionally have no bias but can represent a normal audio signal to be reproduced.

The rectifier 120 converts the audio signal at the audio input 110 from the external audio source 200 into a DC signal. The output signal of the rectifier 120 can be converted to a higher or lower level by the DC/DC converter 130. The audio unit 140 can effect audio signal processing, for example active noise cancellation, and the corresponding signal can be output by way of the electroacoustic reproduction transducer 150. As the input signal the power control unit 160 has the voltage value of the audio signal and/or the current value of the audio signal and optionally the voltage value of the power storage means 170. The power control unit 160 can output as its output signal a control signal to the unit 180 or to the audio unit 140 and can control the functioning of the electronic unit 180 or the audio unit 140.

According to the first embodiment power is extracted from the input audio signal by means of the rectifier unit 150 and/or the DC/DC converter 130 and the extracted power can be put into intermediate storage in the power storage unit 170 or used for the power supply to the audio unit 140, the power control unit 160 and/or the electronic unit 180. If it should not be possible to extract sufficient power from the input audio signal then components of the electronic unit 180 and/or the audio unit 140 can be at least temporarily deactivated. For that purpose the power control unit 160 can be coupled to the audio unit 140 to be able to establish whether the audio unit 140 is receiving sufficient power from the audio signal to be able to suitably reproduce the audio signal on the electroacoustic reproduction transducer 150, to be able to effect active noise cancellation or to be able to effect other audio signal processing.

According to the invention the DC/DC converter 130 can use the power from the power storage unit 170 to supply an electronic system of the earpiece with a suitable voltage.

According to the invention the DC/DC converter 130 is so controlled that the input resistance $R_L$ is kept substantially constant. Power adaptation can be achieved by means of a variation in the input resistance for example by voltage maximization. It is possible in that way to provide for improved adaptation to the audio source.

The DC/DC converter 130 also serves to feed the power storage unit 170. According to the invention the power which can be used for the system is proportional to the voltage $U_{Q1}$, wherein the voltage is controlled at the power storage unit by the power control unit.

Thus the efficiency of the earpiece or the headset can be improved in comparison with the state of the art which uses a linear regulator or a linear amplifier.

By virtue of the fact that a part of the power required for the earpiece or the headset is not extracted from a power storage means in the earpiece/headset, for example in the form of a battery or an accumulator, but is extracted from the input audio signal the power storage means (the battery/accumulator) can be dispensed with or at least the service life thereof is considerably increased.

Figure 2:
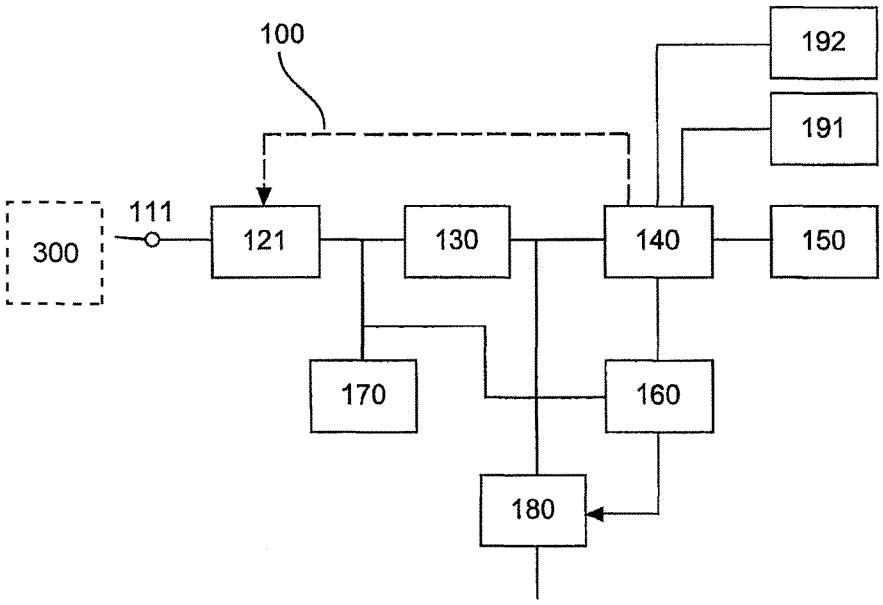
FIG. 2 shows a schematic block circuit diagram of a headphone or a headset according to a second embodiment.

FIG. 2 shows a schematic block circuit diagram of an earpiece or a headset according to a second embodiment. The earpiece or the headset 100 has a first DC/DC converter 121 connected to an external voltage supply 300 by way of a connection 111, wherein the external voltage supply represents a microphone feed voltage or a feed voltage of a mobile device. The first DC/DC converter 121 converts the input voltage into an output voltage which can be higher or lower than the input voltage. A second DC/DC converter 130 is coupled to the first DC/DC converter 121. The second DC/DC converter 130 serves to supply the audio unit 140 which for example can have an active noise cancellation unit or another audio processing unit with a suitable (for example constant) output voltage. The first DC/DC converter 121 can serve to feed the storage unit 170. The storage unit 170 can be for example in the form of a capacitor, for example an ultra-cap. The earpiece or the headset according to the second embodiment further has a first microphone 191 and a second microphone 192. The first microphone 191 serves as a microphone for active noise cancellation and the second microphone 192 can be in the form of a boom microphone supplied with a microphone feed voltage by way of the input 111. The earpiece or the headset further has a power control unit 160 which provides for voltage monitoring of the storage unit 170. The power control unit 160 can optionally also be adapted to limit the operation of the audio unit or the electronic unit 180 if there is not sufficient power in the storage unit 170. For example the level of active noise cancellation can be reduced to reduce the power consumption. If however the storage unit 170 has for example a very great deal of power then that power can be used for example for the electronic unit 180.

The first DC/DC converter 121 has for the target parameter a variable microphone voltage as a reference in order thus to achieve a voltage-dependent load resistance together with the first DC/DC converter. According to the second embodiment a maximum possible amount of power can be extracted from the microphone feed for the boom microphone 192 by the first converter unit 121. The power which can be used for the earpiece or the headset is proportional to the voltage at the storage unit 170.

The advantages of the earpiece or the headset according to the second embodiment correspond to the advantages of the earpiece or the headset of the first embodiment.

Depending on the audio source involved a differing amount of energy can be extracted from the audio signal. An aviation microphone connection provides for example a voltage of between 8 and 16 V with an output resistance of 470 ohms, that is to say the connection can provide at least 60 mW. An analog audio stereo signal with a 32 ohm load can provide 1 Vrms, that is to say a power of 62.5 mW. A microphone connection on a cellular phone or a mobile device can provide for example 3.3 V with an output resistance of 1 kohm, that is to say the mobile device can provide 5 mW. An analog audio stereo signal with a load of 8 ohms can provide a voltage of 150 mVrms and a power of 5.6 mW.

Optionally an ultra-cap can be used as the power storage means.

According to the invention between 0 and 100% of the power from the audio signal can be at least partly fed to the power storage means.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An earpiece or a headset comprising an audio input configured to receive an audio signal to be reproduced;

at least one electroacoustic reproduction transducer configured to reproduce the received audio signal;

an audio unit configured to effect audio processing of the received audio signal;

at least one converter unit configured to extract power from the audio signal received at the audio input;

a power storage means configured to at least partially intermediately store the power extracted from the audio signal; and a power control unit configured to control the extraction of the power from the audio signal and to control a power supply of the audio unit;

wherein the power control unit is adapted to limit a mode of operation of the earpiece or the headset by reducing a level of active noise cancellation to reduce a power consumption of the audio unit if there is no longer sufficient power in the power storage means.

2. The earpiece or headset as set forth in claim 1;

wherein the power control unit monitors whether, after extraction of power from the received audio signal, there is sufficient power in the audio signal to be able to drive the electroacoustic reproduction transducer, operate the audio unit, or both.

3. An earpiece or headset comprising:

an electroacoustic reproduction transducer;

an audio unit configured to effect audio processing of an audio signal;

a boom microphone;

an input configured to receive a microphone feed supply for the boom microphone;

at least one converter configured to extract power from the microphone feed signal;

a power storage means configured to at least partially intermediately store the power extracted from the microphone feed signal; and a power control unit configured to control the extraction of power from the microphone feed signal and to control the power supply of the audio unit;

wherein the power control unit is adapted to limit a mode of operation of the earpiece or the headset by reducing a level of active noise cancellation to reduce a power consumption of the audio unit if there is no longer sufficient power in the power storage means.

4. A method of controlling an earphone or a headset, wherein the earphone or the headset has an audio input, an audio unit, and an electroacoustic reproduction transducer, comprising the steps:

receiving an audio signal which is to be reproduced by way of the audio input;

effecting audio processing of the received audio signal;

extracting power from the audio signal received at the audio input;

effecting at least partial intermediate storage of the power extracted from the audio signal;

controlling the extraction of power from the audio signal and controlling a power supply of the audio unit; and limiting a mode of operation of the earphone or the headset by reducing a level of active noise cancellation to reduce a power consumption of the audio unit if there is no longer sufficient power in the power storage means.

5. The earpiece or headset as set forth in claim 1;

wherein at least one of the power extracted by the at least one converter unit and the power stored by the power storage means is used at least partially as supply power for operating at least the audio unit.

6. The earpiece or headset according to claim 5, further comprising:

a rectifier adapted to rectify the audio signal received at the audio input to obtain a DC signal.

7. The earpiece or headset according to claim 6, further comprising:

a DC/DC converter, wherein a DC signal fed into the DC/DC converter is provided by the rectifier or by the power storage means.

8. The earpiece or headset as set forth in claim 3;

wherein at least one of the power extracted by the at least one converter unit and the power stored by the power storage means is used at least partially as supply power for operating at least the audio unit.

9. The earpiece or headset according to claim 8, further comprising:

a rectifier adapted to rectify the audio signal received at the input to obtain a DC signal.

10. The earpiece or headset according to claim 9, further comprising: a DC/DC converter, wherein a DC signal fed into the DC/DC converter is provided by the rectifier or by the power storage means.

11. The method as set forth in claim 4, further comprising:

wherein at least one of the extracted power and the stored power is used at least partially as supply power for operating at least the audio unit.

12. The method as set forth in claim 11, further comprising:

a step of rectifying the received audio signal to obtain a DC signal.

13. The method as set forth in claim 12;

wherein the earphone or headset further has a DC/DC converter, the method further comprising a step of DC/DC converting a DC signal provided by the rectifier or by the power storage means.

* * * * *